US006918147B2

(12) United States Patent
Stackman et al.

(10) Patent No.: US 6,918,147 B2
(45) Date of Patent: Jul. 19, 2005

(54) RIGID FOLDABLE PORTABLE DIAPER CHANGING PAD

(75) Inventors: Lisa F. Stackman, Pine Brook, NJ (US); Garrett L. Stackman, Pine Brook, NJ (US)

(73) Assignee: Diaperbridge Products, LLC, Pine Brook, NJ (US)

( * ) Notice: Subject to any disclaimer, the term of this patent is extended or adjusted under 35 U.S.C. 154(b) by 0 days.

(21) Appl. No.: 10/422,903

(22) Filed: Apr. 25, 2003

(65) Prior Publication Data

US 2004/0211003 A1 Oct. 28, 2004

(51) Int. Cl.[7] ..... A47K 3/164

(52) U.S. Cl. ..... 5/655; 4/551; 4/572.1; 4/659

(58) Field of Search ..... 5/655, 420, 722; 4/551, 572.1, 659; 160/135; 108/47, 42, 44, 70, 67

(56) References Cited

U.S. PATENT DOCUMENTS

| | | | | | |
|---|---|---|---|---|---|
| 1,934,615 | A | * | 11/1933 | Selverstone | 297/229 |
| 2,020,702 | A | * | 11/1935 | Samuel | 2/2.5 |
| 2,128,978 | A | * | 9/1938 | Akin | 5/93.1 |
| 2,429,350 | A | * | 10/1947 | Farrand | 5/98.1 |
| 3,018,132 | A | * | 1/1962 | Baker et al. | 297/377 |
| 3,143,748 | A | | 8/1964 | Manning | |
| 4,123,809 | A | * | 11/1978 | Pugh | 4/659 |
| 4,133,063 | A | * | 1/1979 | Jones-Steele | 5/99.1 |
| 4,698,862 | A | * | 10/1987 | Mairs | 5/98.1 |
| 4,917,505 | A | | 4/1990 | Bullard et al. | |
| 5,085,212 | A | * | 2/1992 | DeCosta | 607/95 |
| 5,115,524 | A | * | 5/1992 | Antosko | 5/99.1 |
| 5,133,085 | A | | 7/1992 | de Pasquale Amicarelli et al. | |
| 5,265,292 | A | | 11/1993 | Underell | |
| 5,299,336 | A | * | 4/1994 | Marteeny | 5/655 |
| D367,771 | S | | 3/1996 | Julian | |
| 5,551,108 | A | | 9/1996 | Butler, III | |
| 5,960,848 | A | * | 10/1999 | Schirer | 160/135 |
| 6,010,096 | A | * | 1/2000 | Baghdasarian | 244/173 |
| 6,272,704 | B1 | | 8/2001 | Cutler | |
| 6,298,509 | B1 | | 10/2001 | Vickers | |
| 6,327,726 | B1 | | 12/2001 | Weber | |
| 6,421,856 | B1 | | 7/2002 | Furnback | |
| 2001/0033914 | A1 | | 10/2001 | Walker et al. | |

* cited by examiner

*Primary Examiner*—Sunil Singh
(74) *Attorney, Agent, or Firm*—Hoffman, Wasson & Gitler, P.C.

(57) ABSTRACT

A rigid foldable portable diaper changing pad provided with a plurality of support panels. At least one of the support panels is provided with a section overlaying an adjacent panel to provide stability and prevent the panels from being rotated more than 180°. An additional panel provided at a right angle from the plane of the aforementioned panels would be utilized to support the changing pad on a faucet spigot. This panel would also be utilized to prevent scalding of an infant, if the water were to be turned on accidently.

12 Claims, 12 Drawing Sheets

RIGID FOLDABLE PORTABLE DIAPER CHANGING PAD

BACKGROUND OF THE INVENTION

1. Field of the Invention

The present invention is directed to a portable, foldable pad which, when extended, will become a rigid plane and support a baby to change its diaper.

2. Description of the Prior Art

Attitudes toward traveling with children, especially infants, have changed in the last generation. A generation ago, if a family had a small child, baby or infant, various trips, including local trips to restaurants and shopping malls had to be planned very carefully. In many instances, one parent was assigned the task of staying home with the child and the second parent would make an excursion, such as shopping, themselves. This was true since it was quite likely that if the baby accompanied the parents on an excursion, the baby would have to be changed during the trip. This would have been very awkward since most establishments did not include a convenient location for the child or infant to be changed. This problem has been alleviated to some degree since many establishments now include a changing station provided in both the men's and women's restrooms. Although this is a great step forward, many parents are still unwilling to use such a changing station because of the possibility of unsanitary conditions associated with the changing station provided. Furthermore, although many establishments do include such a changing station, not all establishments have made this accommodation.

To alleviate this problem, several prior art patents are directed to a portable diaper changing device. These patents include U.S. Pat. No. 6,272,704, issued to Cutler; U.S. Pat. No. 6,298,509, issued to Vickers and U.S. Design Pat. No. D 367,771, issued to Julian.

The patent to Cutler describes a portable diaper changing board having a plurality of foldable sections including end members 12, 13 and intermediate members 14 and 15. Both the end members and intermediate members are hingedly fastened to adjacent members. Therefore, in use, the changing board may be transported in the manner illustrated in FIG. 3 and then opened for use as shown in FIG. 1. However, as shown in the drawings, it would appear that the end members and intermediate members are constructed from a soft material and would not provide adequate support for the infant unless used on a flat contiguous surface.

The patent to Vickers describes a convertible diaper bag/changing pad. When closed, the bag would allow various items to be transported and when open, it would serve to allow a parent or guardian to change the baby. However, similar to the patent to Cutler, it is conceivable that this patent would not provide adequate support for the child without a contiguous surface underneath.

The patent to Julian illustrates a portable diaper table. While this patent does appear to illustrate a diaper changing table having adequate strength to support the infant, this changing table is bulky and would be unwieldy to easily transport.

U.S. Pat. No. 5,265,292, issued to Underell, illustrates a foldable recliner/lounge pad constructed from four cushions interconnected together. As shown in the drawings, the cushion is transportable as shown in FIG. 1 and is unfolded as shown in FIG. 2 to provide support for an individual. However, this cushion was not designed to be used as a changing table and, due to its length, would not be able to be supported by various facilities generally included in the restroom, such as a sink.

SUMMARY OF THE INVENTION

The deficiencies of the prior art are addressed by the present invention which is directed to a portable, folding changing pad for infants, toddlers and small children. A plurality of panels, hingedly connected to one another, are used to construct the pad. This allows the pad to be folded up for convenience allowing easy transportability. Furthermore, when the pad is needed for its intended use, it can be easily unfolded and placed on a contiguous or non-contiguous support surface for the purpose of changing the infant, toddler or small child. A contiguous support surface would include a surface which would support the entire underside of the diaper changing pad, such a surface would be a planar counter. A non-contiguous surface would constitute a surface which supports only a portion of the underside of the diaper changing pad. Such a surface would include, but not be limited to, a counter surrounding a vanity sink in which the end portions of the diaper changing pad would be supported by the counter and the center portion would extend over the sink, but not within the sink. Additionally, the diaper changing pad according to the present invention could be supported at each of its two ends by a chair. At this point, the diaper changing pad can be secured together using one or both of the Velcro® straps. At least one of the panels of the pad would have an extendable portion so that when the pad is unfolded, this extendible portion would be provided under an adjacent panel, thereby providing stability to the pad. In a preferred embodiment, the pad would include first, second and third foldable panels which would be unfolded in longitudinal manner. In this instance, two of the panels would be provided with this extended portion to allow for the stability of the pad while spanning a contiguous or non-contiguous surface. Adjacent panel portions would include hinges. Based upon the manner in which the panels would be unfolded to form the pad, the size of the hinges could be different dimension.

In yet another embodiment, if the pad is intended to be placed over a sink in a restroom, a fourth guard panel attached to a side edge of one of the three longitudinally situated panels would be unfolded and, with the assistance of a fastening device, such as Velcro®, would fit around the spigot of the sink. This fourth panel would also be used to shield the infant from accidently being scalded by water which might unintentionally flow through the spigot.

BRIEF DESCRIPTION OF THE DRAWINGS

The foregoing and other features and objects of the present invention will be described in detail herein with reference to the accompanying drawings, in which.

DETAILED DESCRIPTION OF THE PRESENT INVENTION

Figure 1:
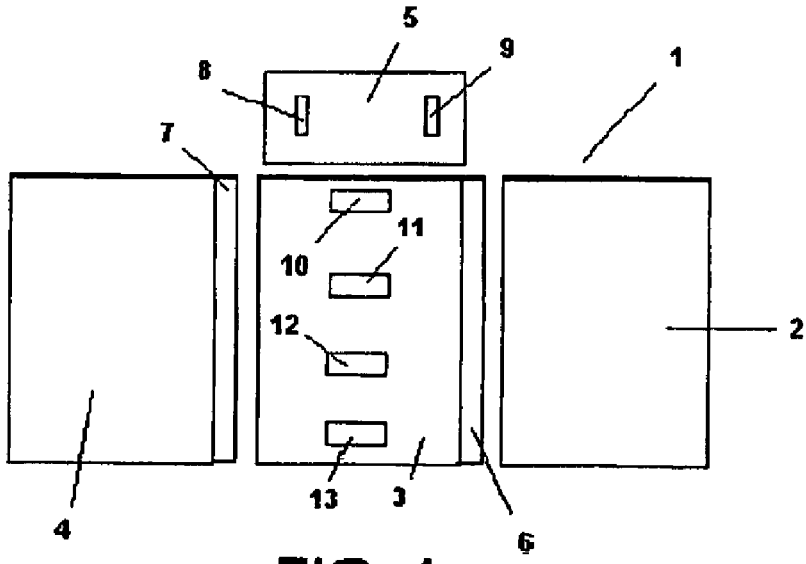
FIG. 1 is a top view of the main panels used in the present invention.
Figure 2:
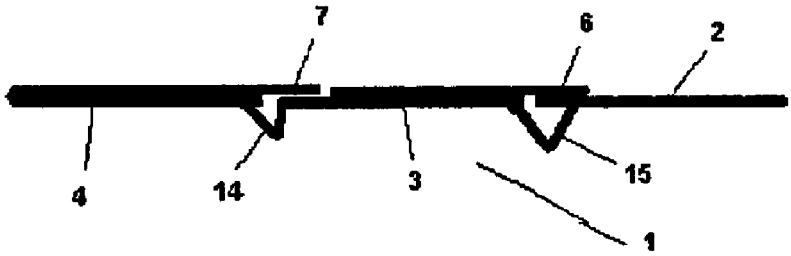
FIG. 2 is a side view of the longitudinal panels used in the present invention.

The major components of the present invention are illustrated with respect to FIG. 1. These components include a first generally rectangular rigid end panel 2, a second generally rectangular rigid middle panel 3 and a third generally rectangular rigid end panel 4. In use, panels 2, 3 and 4 are generally provided in a straight line as shown in FIG. 1. The second panel 3 includes a portion 6 extending along one end of the panel 3. A similar portion 7 extends along one end of panel 4. When the pad is in the unfolded state as shown in FIG. 2, portion 6 of panel 3 would overlay a segment of panel 2. Similarly, portion 7 of the panel 4 would overlay a segment of the middle panel 3. The middle panel 3 would include four primarily rectangular cut-out portions 10, 11, 12 and 13. Velcro® or other devices for securing the infant, toddler or small child in place would be inserted through these cut-out portions as will be subsequently illustrated. Although four cut-out portions have been shown, it can be appreciated that this number is not crucial to the teachings of the present invention. Each of the three panels 2, 3 and 4 would be the same size, such as approximately eight inches by twelve inches. Additionally, although three longitudinal panels have been illustrated, it is noted that the exact number of panels is not of crucial importance. For example, two longitudinal or four longitudinal panels may be employed as long as these panels are fastened together to allow the pad to be folded and unfolded.

An additional relatively rectangular panel guard 5 is provided adjacent to one side of the middle panel 3. Generally, the rectangular cut-out portions 8 and 9 would allow Velcro® or similar fastening sashes to pass therethrough. The main purpose of this panel would be to allow the entire pad to be suspended from a spigot associated with a restroom sink. The panel 5 would also protect the child from being accidently scalded if hot water would inadvertently flow through the spigot while the child is being changed. This would occur since, when in use, the panel 5 would be angled with respect to one side of the panel 3 and would extend in a second plane with respect to the panels 2, 3 and 4.

Figure 3:
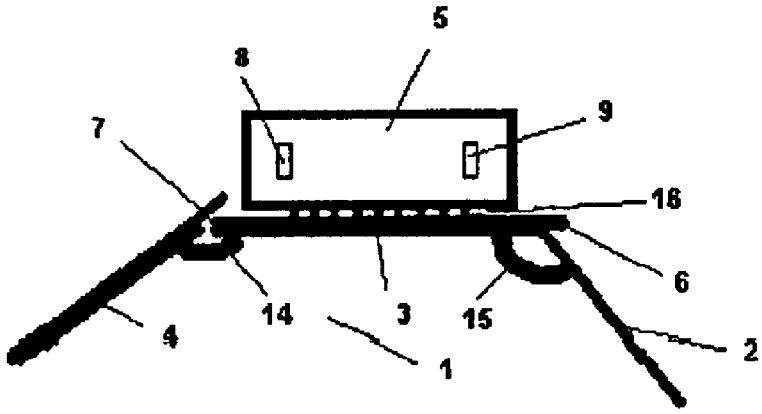
FIG. 3 is a side view of the present invention showing the panels in a partially unfolded state.
Figure 4:
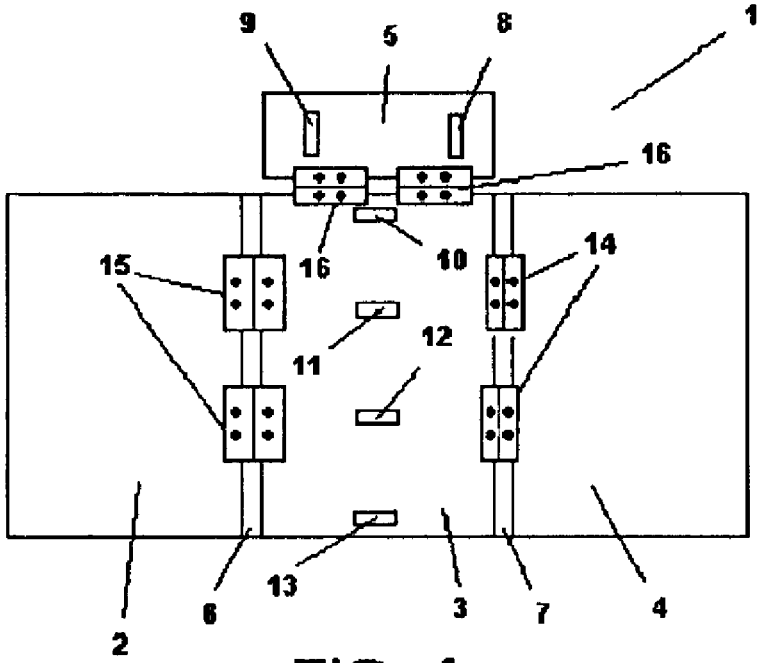
FIG. 4 is a bottom view of the four panels connected together.

As illustrated with respect to FIGS. 2, 3 and 4, hinges are provided to connect adjacent panels to one another to allow the pad to be folded for ease of transportability and then unfolded for use. Panel 3 is connected to panel 4 by two plastic hinges 14 extending along at least a portion of the overlay panel 7, as well as over portions of both panels 3 and 4. Panel 2 is connected to panel 3 through the use of two plastic hinges 15 extending along at least a portion of the overlay section 6, as well as traversing a portion of panel 2 as well as a similar portion of panel 3. As shown in FIG. 2, the overlay portion 6 is thinner than panel 3 and the overlay portion 7 is thinner than panel 4. The pad, according to the present invention, is constructed so as to require that when the pad is to be folded for transportability, panel 4 would be folded over panel 3 and panel 2 would then be folded over panel 4. Consequently, it is important that hinges 15 be larger in area than hinges 14. Obviously, if panel 2 was to be initially folded over panel 3 and then panel 4 would be folded over panel 2, the size of hinges 15 would be less in area than the hinges 14. As shown in FIGS. 3 and 4, two plastic hinges 16 would be used to attach panel 5 to the middle panel 3. The panel 5, when not in use, would be folded on top of the middle panel 3. When in use, panel 5 would be angled with respect to panel 3, as shown in FIG. 3. Additionally, although two plastic hinges are employed to connect the middle panel to the end panels, the exact number of hinges and the material of which they are made, is not of crucial importance.

Figure 5:
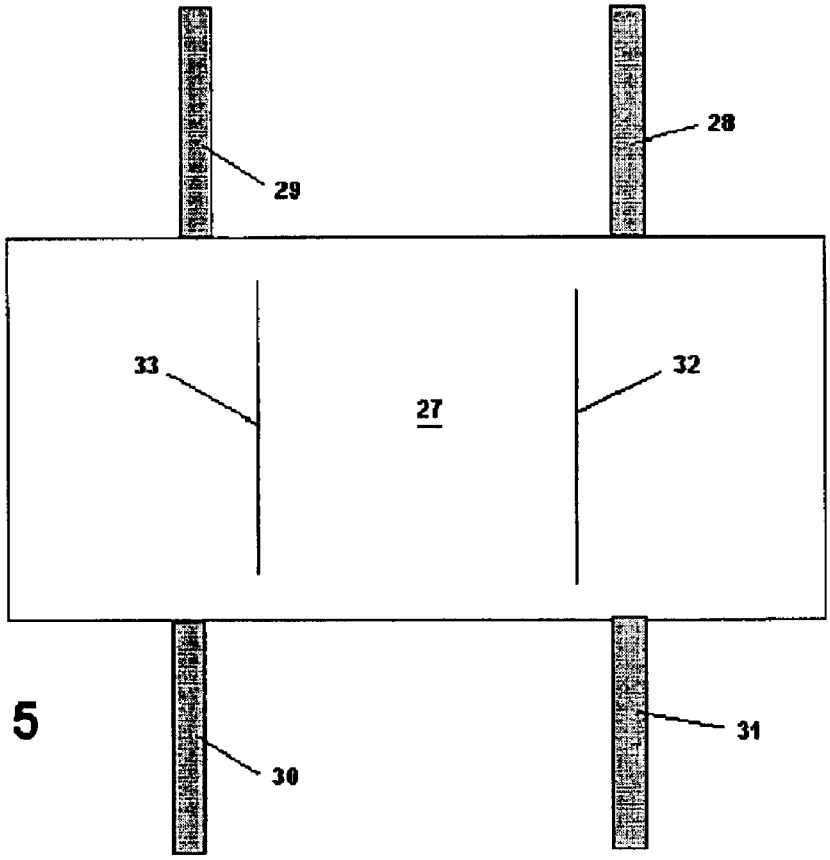
FIG. 5 is a top view of a changing pad used in conjunction with the panels shown in FIG. 1.

When the pad is in the unfolded position to be used to change a baby's diaper, the baby would be supported by panels 2, 3 and 4. Although these panels would be constructed from a plastic material, it would be advantageous to utilize a cushion which will be placed upon the panels 2, 3 and 4 when the baby is being changed. This cushion 27 is illustrated in FIG. 5. The cushion is secured in place through the use of Velcro® straps 28, 29, 30 and 31. However, other types of sashes or buckle restraining devices could be utilized in lieu of the Velcro® straps shown in FIG. 5. For ease of transportability, the pad 27 is provided with fold lines 32 and 33 which extend almost completely along the width of the cushion 27. The dimensions of the cushion 27 would generally approximate the total dimensions of the panels 2, 3 and 4. Therefore, the placement of the fold lines 32 and 33 would be approximately over the hinges 14 and 15. It should be stressed that the utilization of the cushion 27 would be for sanitary purposes, as well as for comfort since it would be much easier to completely clean the cushion 27 than the panels 2, 3, 4, as well as for comfort of the baby during changing.

Figure 6:
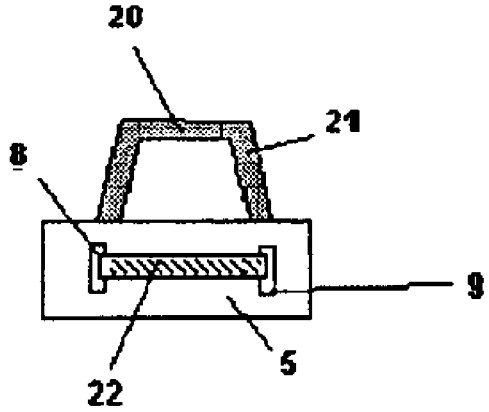
FIG. 6 is a side view of the panel shown in FIG. 4 with the Velcro® straps inserted therein.
Figure 7:
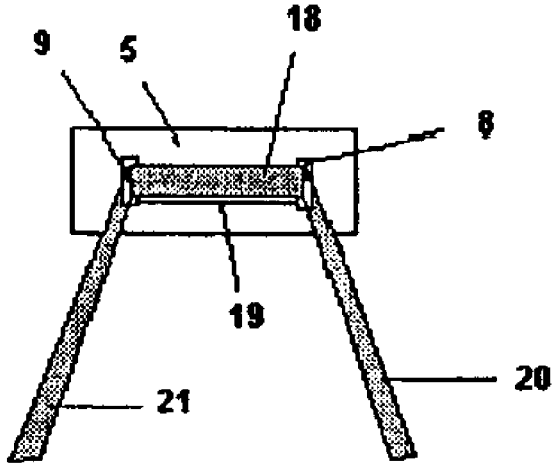
FIG. 7 is a back view of the panel shown in FIG. 6.
Figure 8:
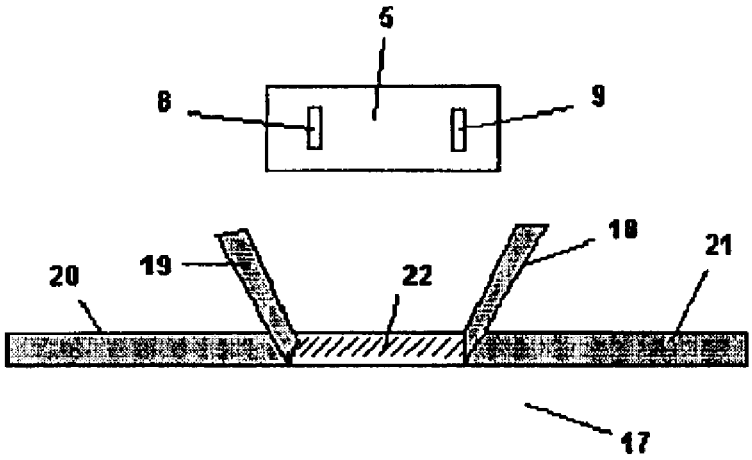
FIG. 8 is a side view of one of the panels and a connecting Velcro® strap.
Figure 11:
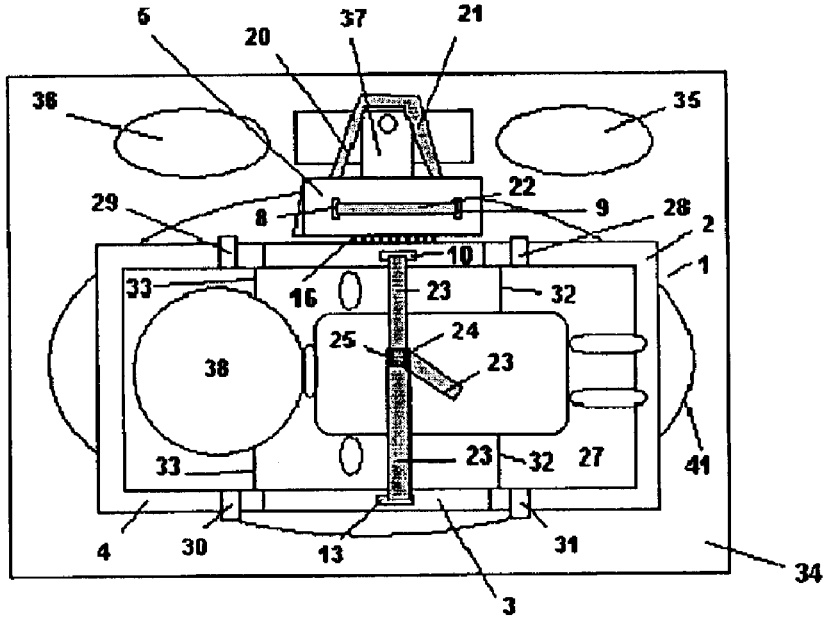
FIG. 11 is a top view of the present invention in use.

FIGS. 6, 7 and 8 are directed to the manner in which a fastening device 17 using, for example, a double Velcro® strap would allow the panel 5 to support the changing pad 1 over a faucet spigot 37 as shown in FIG. 11. When a Velcro® fastener is to be utilized, such a fastener would include a left side 20 as well as a right side 21 connected together by a middle section 22. Section 18 of the Velcro® fastener would extend from the right side 21 and section 19 of the Velcro® fastener would extend from the left side 20. The middle portion 22 as well as portions 18 and 19 would be inserted through the cut-outs 8 and 9 of panel 5 as shown in FIGS. 6 and 7. Velcro® portions 20 and 21 would then intersect one another as illustrated in FIG. 6 so that it can be extended around the faucet spigot 37.

Figure 9:
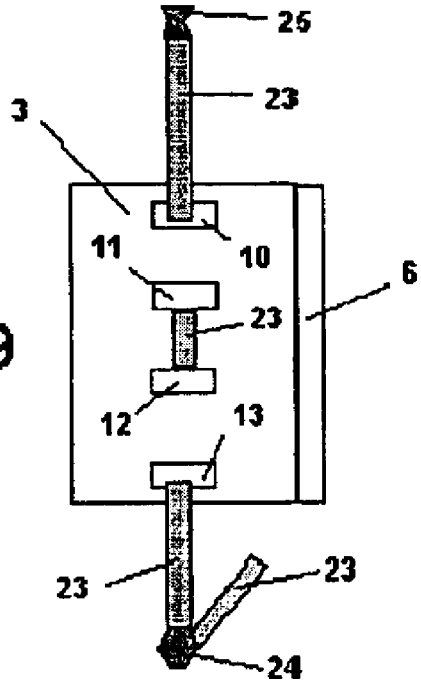
FIG. 9 is a top view of the center panel of the present invention.

FIG. 9 illustrates the middle panel 3 and the manner in which a safety strap 23 would be threaded through the cut-outs 10, 11, 12 and 13 to act as a restraining device to insure that the baby is safe when its diaper is changed. Fastening devices such as an adjustable side release clip 24 cooperating with a side release fastener 25 would be used to secure the baby in place. As can be appreciated, other types of clasps, clips, buckles or fasteners may be employed.

Figure 10:
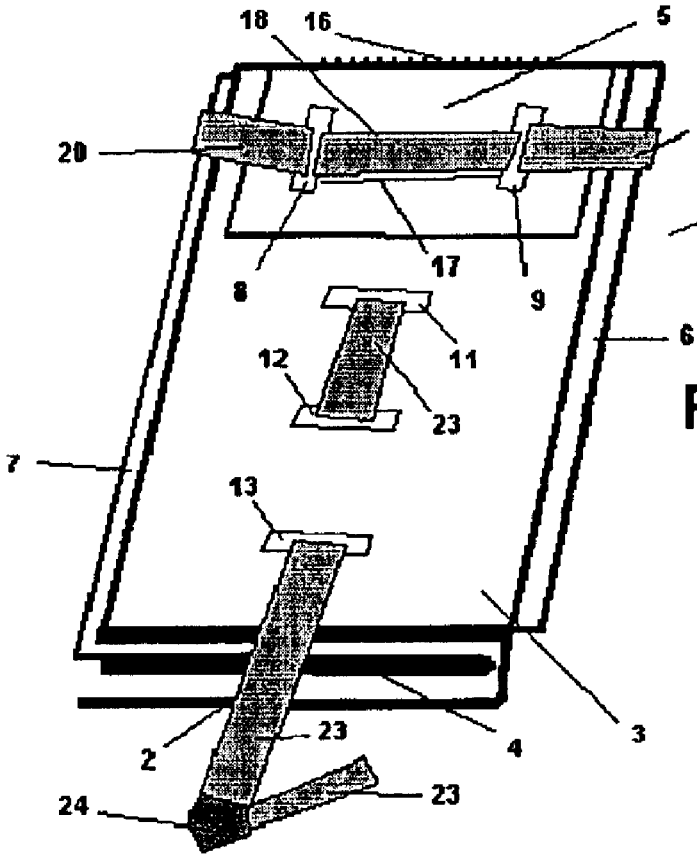
FIG. 10 is a view of the invention in the folded position.

FIG. 10 shows the rigid, foldable, portable diaper changing pad in its folded position. In this position, panel 4 is first folded so that it extends under panel 3 and then panel 2 is folded so that it extends under panel 4. Panel 5 is folded and would extend over a portion of panel 3. In its folded position, overlay portions 6 and 7 would be exposed. It is noted that FIG. 10 does not illustrate the placement of the cushion 27 as shown in FIG. 5. This cushion may be removed after use and prior to folding the pad. However, adequate space for a thin pad or cushion with the thin pad still attached could be accommodated such that, when folded, the portable diaper changing pad would fold relatively flat.

Figure 12:
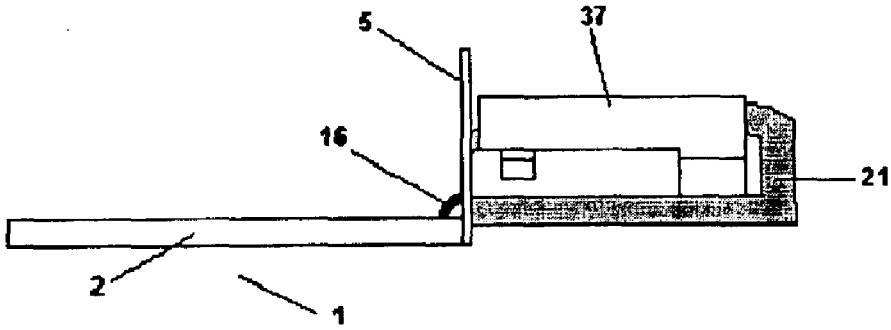
FIG. 12 is a side view of the present invention illustrated in FIG. 10.

FIGS. 11 and 12 show the pad as it is being used over a vanity sink top 34 having a basin 41, a cold water faucet handle 35 as well as a hot water faucet handle 36. A faucet spigot 37 is also shown. In its extended position, panel 5 would allow the Velcro® fastening elements 20 and 21 to support the pad 1 over the vanity 34 and the basin 41. The cushion 27 is affixed to the top surface of the panels 2, 3 and 4 through the use of the Velcro® straps 28, 29, 30 and 31. The safety strap webbing 23 would secure a baby 38 in place and allow the baby to be changed. The panel 5 would lay over or against the output of the spigot 37 and will act as a barrier to keep water (especially hot water) from hitting the baby should the water be turned on accidently.

Once the baby has been properly changed, the safety strap webbing 23 would be untied and the baby lifted from the changing pad 1. At this point, the cushion 27 could be removed and the pad itself could be folded in the manner illustrated with respect to FIG. 10 or the pad could be folded over the thin pad or cushion which would remain affixed to the pad.

If the diaper changing pad were to be used on a completely contiguous surface such as a countertop, or the ground, panel 5 would not be raised as shown in FIGS. 11 and 12 and would merely be supported by the contiguous surface similar to panels 2, 3, and 4.

If the diaper changing pad were to be used between two chairs, the panel 5 would be perpendicular to the panels 2, 3 and 4.

While the present invention has been described in detail with reference to a particular embodiment, and to other options presently known to the inventors, the invention should not be considered as limited thereto or thereby. Various modifications within the spirit and scope of the invention will be apparent to ordinarily skilled artisans. For example, although the present invention has been described utilizing three main co-linear panel portions, the number of panel portions need not be so limited and could include two panel portions or more than three panel portions.

What is claimed is:

1. A diaper changing support device, comprising:

a plurality of rigid planar support panels comprising a first panel, a middle panel and a second panel, each of said support panels hingedly fastened to its adjacent support panel and each of said support panels provided co-linear with respect to the remaining support panels when the diaper changing support device is converted from a closed folded position to an open position to support a child on said plurality of support panels, wherein said middle panel includes a first overlay portion extending for the entire length of one end of said middle panel, said first overlay portion covering a portion of said first panel when the diaper changing support device is in said open position;

a substantially rigid planar guard panel hingedly fastened laterally to said middle panel, said guard panel angled with respect to one of said support panels when said guard panel is moved from said closed folded position to said open position to protect the child when the child's diaper is changed, and further wherein said guard panel extending over only said middle panel, when said guard panel is moved from said open position to said closed folded position; and a first fastening device attached to said guard panel for attachment to a spigot associated with a wash basin.

2. The diaper changing support device in accordance with claim 1, wherein said three co-linear support panels and said guard panel are plastic.

3. The diaper changing support device in accordance with claim 1, wherein said second panel includes a second overlay portion extending for the entire length of one end of said second panel, said second overlay portion covering a portion of said middle panel when the diaper changing support device is in said opening position.

4. The diaper changing support device in accordance with claim 1, including a first hinge device attaching said first panel to said middle panel and a second hinge device attaching said middle panel to said second panel, wherein the size of said first hinge device and the size of said second hinge device are unequal to accommodate converting the diaper changing device from said open position to said closed folded position.

5. The diaper changing support device in accordance with claim 1, further including a second fastening device for securing the child to the diaper changing support device during the changing of the child.

6. The diaper changing support device in accordance with claim 5, wherein said second fastening device is connected to one of said support panels.

7. The diaper changing support device in accordance with claim 1, further including a support cushion covering said support panels when the diaper changing support device is in said open position.

8. A diaper changing support device, comprising:

a first substantially rigid planar support panel including a first overlay portion extending for the entire length of one end of said first support panel, said first overlay portion formed as one piece with said first substantially rigid planar support panel;

a middle substantially rigid planar support panel fastened to said first support panel, said middle panel including a second overlay portion extending for the entire length of one end of said middle support panel, said second overlay portion formed as one piece with into said middle substantially rigid planar support panel;

a second substantially rigid planar support panel fastened to said middle panel;

a first hinge device attaching said first support panel to said middle support panel;

a second hinge device attaching said middle support panel to said second support panel;

wherein said first overlay portion covers a portion of said middle panel, and said second overlay portion covers a portion of said second panel when the diaper changing support device is converted from a closed folded position to an operative position with said first support panel, said middle support panel and said second support panel being co-linear with respect to one another to support a child thereon;

further wherein the size of said first hinge and the size of said second hinge are unequal to accommodate converting the diaper changing device from said operative position to said closed folded position.

9. The diaper changing support device in accordance with claim 8, further including a substantially rigid planar guard panel hinged laterally to one of said support panels, said guard panel angled with respect to one of said support panels when said guard panel is moved from said closed folded position to said operative position to protect the child when the child's diaper is changed.

10. The diaper changing support device in accordance with claim 9, further including a fastening device attached to said guard panel for attachment to a spigot associated with a wash basin.

11. A diaper changing support device comprising:

a first substantially rigid support panel;

a middle substantially rigid support panel;

a second substantially rigid support panel;

a first hinge device attaching said first support panel to said middle support panel;

a second hinge device attaching said middle support panel to said second support panel;

a guard panel attached to said middle support panel, said guard panel angled with respect to said middle support panel when said guard panel is moved from a closed folded position to an open position;

wherein the size of said first hinge and the size of said second hinge are unequal to accommodate converting the diaper changing device from said closed folded position to said open position, and further wherein said first support panel, said middle support panel and said second support panel being co-linear when the diaper changing support device is in said open position.

12. The diaper changing support device in accordance with claim 11, further including a fastening device attached to said guard panel for attachment to a spigot associated with a wash basin.

* * * * *